US007506621B2

(12) United States Patent
Takahashi et al.

(10) Patent No.: US 7,506,621 B2
(45) Date of Patent: Mar. 24, 2009

(54) VALVE TIMING CONTROL SYSTEM

(75) Inventors: Kinya Takahashi, Obu (JP); Masayasu Ushida, Okazaki (JP); Takao Nojiri, Anjo (JP); Seiji Yaokou, Anjo (JP); Jun Yamada, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 20 days.

(21) Appl. No.: 11/854,156

(22) Filed: Sep. 12, 2007

(65) Prior Publication Data

US 2008/0066572 A1 Mar. 20, 2008

(30) Foreign Application Priority Data

Sep. 15, 2006 (JP) ..... 2006-250873

(51) Int. Cl.
*F01L 1/34* (2006.01)

(52) U.S. Cl. ..... 123/90.15; 123/90.12; 123/90.17; 464/160

(58) Field of Classification Search ..... 123/90.12, 123/90.13, 90.15, 90.16, 90.17, 90.18, 90.27, 123/90.31; 464/1, 2, 160
See application file for complete search history.

(56) References Cited

U.S. PATENT DOCUMENTS 6,763,791 B2 7/2004 Gardner et al.
7,182,052 B2 2/2007 Yaoko et al.
7,194,992 B2 * 3/2007 Smith ..... 123/90.17
2007/0107684 A1 5/2007 Takahashi et al.

FOREIGN PATENT DOCUMENTS

JP 2003-106115 4/2003
JP 2006-46315 2/2006

OTHER PUBLICATIONS

U.S. Appl. No. 11/783,002, filed Apr. 2007, Ushida et al.
U.S. Application of Takahashi et al. U.S. Appl. No. 11/854,249, filed Sep. 12, 2007.
U.S. Application of Takahashi et al. U.S. Appl. No. 11/854,337, filed Sep. 12, 2007.

* cited by examiner

*Primary Examiner*—Ching Chang
(74) *Attorney, Agent, or Firm*—Nixon & Vanderhye PC

(57) ABSTRACT

A phase control valve, which supplies a drive hydraulic pressure to an advance chamber or a retard chamber, is integrated with a drain switch valve, which controls opening and closing of an advance drain control valve and opening and closing of a retard drain control valve, to form a solenoid spool valve. The advance drain control valve is provided in an advance check valve bypass passage, which bypasses an advance check valve, and is driven by a pilot hydraulic pressure to open and close the advance check valve bypass passage. The retard drain control valve is provided in a retard check valve bypass passage, which bypasses a retard check valve, and is driven by a pilot hydraulic pressure to open and close the retard check valve bypass passage.

7 Claims, 9 Drawing Sheets

VALVE TIMING CONTROL SYSTEM

CROSS REFERENCE TO RELATED APPLICATION

This application is based on and incorporates herein by reference Japanese Patent Application No. 2006-250873 filed on Sep. 15, 2006.

BACKGROUND OF THE INVENTION

1. Field of the Invention

The present invention relates to a valve timing control system for an internal combustion engine.

2. Description of Related Art

A previously proposed technique will be described with reference to FIG. 8 (some reference numerals used in FIG. 8 are common to those described in the following embodiments).

Hereinafter, a valve timing control system, which changes opening and closing timing of at least one of an intake valve(s) and an exhaust valve(s) of an internal combustion engine, will be also referred to as a variable valve timing control system and will be denoted as a VVT system. A previously proposed VVT system shown in FIG. 8 includes a variable valve timing mechanism 2, a hydraulic control system and an electronic control unit (ECU) 3. The variable valve timing mechanism 2 is also referred to as a variable camshaft timing mechanism 2 and will be denoted as a VCT mechanism 2. The VCT mechanism 2 can linearly change the opening and closing timing of the valve. The hydraulic control system hydraulically controls the operation of the VCT mechanism 2. The ECU 3 electrically controls a phase control valve 22, which is provided in the hydraulic control system. The phase control valve 22 will be also referred to as an oil control valve 22 and will be denoted as an OCV 22.

The VCT mechanism 2 includes a housing rotor 4 and a vane rotor 5. The housing rotor 4 is driven to rotate by the crankshaft of the engine. The vane rotor 5 drives a camshaft of the engine. The vane rotor 5 is rotated relative to the housing rotor 4 by a hydraulic pressure difference between a hydraulic pressure of advance chambers A and a hydraulic pressure of retard chambers B to adjust an amount of advance of the camshaft relative to the crankshaft.

Here, the camshaft is used to drive the intake valve(s) or the exhaust valve(s) to open and close the same, so that the torque fluctuation is generated in the camshaft at the time of opening and closing the valve(s).

The torque fluctuation of the camshaft is transmitted to the vane rotor 5, so that the vane rotor 5 shows the torque fluctuation toward the retard side and the advance side relative to the housing rotor 4.

When the torque fluctuation applied to the vane rotor 5 is increased toward the retard side, a force acts on the hydraulic pressure of the advance chambers A to discharge the hydraulic pressure from the advance chambers A. In contrast, when the torque fluctuation applied to the vane rotor 5 is increased toward the advance side, a force acts on the hydraulic pressure of the retard chambers B to discharge the hydraulic pressure from the retard chambers B. The torque fluctuation toward the retard side is larger than the torque fluctuation toward the advance side.

Thus, when the hydraulic pressure supplied to the advance chambers A is increased from a low hydraulic pressure state of the advance chambers A (a retarded state) to change the phase of the camshaft from the retard side to a target phase on the advance side, the vane rotor 5 is pushed backward toward the retard side due to the torque fluctuation, so that the response time, which is required to reach the target phase, is disadvantageously lengthened, as shown by a dotted line in FIG. 9.

In order to address the above disadvantage, it has been proposed to provide an advance check valve 23 in an advance fluid passage 31, which conducts the hydraulic pressure from the OCV 22 to the corresponding advance chamber A, to permit the hydraulic fluid to flow from the OCV 22 to the advance chambers A while limiting the hydraulic fluid to flow from this advance chamber A to the OCV 22 (see, for example, Japanese Unexamined Patent Publication No. 2006-46315 that corresponds to U.S. Pat. No. 7,182,052).

When the advance check valve 23 is provided, the vane rotor 5 is not pushed backward toward the retard side by the torque fluctuation at the time of changing the phase of the camshaft from the retard side to the target phase on the advance side, as indicated by a solid line in FIG. 9 to improve the response in the advance operation.

In contrast, when the phase of the camshaft is changed from the advance side to the tart phase on the retard side, the hydraulic pressure of the advance chambers A needs to be drained while bypassing the advance check valve 23. In view of this, in Japanese Unexamined Patent Publication No. 2006-46315, an advance drain control valve 25, which opens and blocks an advance check valve bypass passage 24, is provided.

The advance drain control valve 25 of Japanese Unexamined Patent Publication No. 2006-46315 is an opening/closing valve, which uses the hydraulic pressure supplied from the OCV 22 to the advance chamber A as a pilot hydraulic press. When the hydraulic pressure, which is supplied from the OCV 22 to the advance chamber A, is increased, the advance drain control valve 25 blocks the advance check valve bypass passage 24. In contrast, when the hydraulic pressure, which is supplied from the OCV 22 to the advance chamber A, is decreased, the advance drain control valve 25 opens the advance check valve bypass passage 24 due to action of a spring to drain the hydraulic pressure from the advance chamber A.

As discussed above, in the above technique, the hydraulic pressure, which is supplied from the OCV 22 to the advance chamber A, is used as the pilot hydraulic pressure of the advance drain control valve 25. Thus, in the case where the phase of the camshaft is changed from the retard side to the target phase on the advance side, when the hydraulic pressure of the advance chambers A is fluctuated (pulsed) by the torque fluctuation applied from the camshaft to the vane rotor 5, a valve element of the advance drain control valve 25 is fluctuated by the pressure pulsation. Therefore, the advance check valve bypass passage 24, which needs to be blocked, is repeatedly opened and closed. This may possibly deteriorate the response in the advance operation.

In order to address the above disadvantage, it is conceivable to provide a drain switch valve 29, which controls the pilot hydraulic pressure of the advance drain control valve 25, as shown in FIG. 8. The drain switch valve 29 is also referred to as an oil switching valve 29 and will be denoted as an OSV 29. Here, it should be noted that the provision of the OSV 29 in the manner shown in FIG. 8 should not be considered as a prior art.

The OCV 22 and the OSV 29 need to be operated synchronously.

However, when the OSV 29 is provided separately from the OCV 22, a performance of an electric actuator (e.g., a solenoid actuator) of the OCV 22 and a performance of an electric actuator (e.g., a solenoid actuator) of the OSV 29 may differ from one another, or a variation may occur in applied electric current, so that the OCV 22 and the OSV 29 may not precisely synchronized in some cases.

Furthermore, when the OSV 29 is installed separately from the OCV 22, the mounting flexibility may be deteriorated.

Also, when the OSV 29 is installed separately from the OCV 22, the number of components is increased to cause an increase in the cost.

SUMMARY OF THE INVENTION

The present invention addresses the above disadvantages. Thus, it is an objective of the present invention to provide a valve timing control system, which improves accuracy in synchronization between a phase control valve and a drain switch valve and mounting flexibility while enabling a reduction in a number of components.

To achieve the objective of the present invention, there is provided a valve timing control system for an internal combustion engine. The valve timing control system includes a variable valve timing mechanism, a phase control valve, a hydraulic control arrangement and a drain switch valve. The variable valve timing mechanism includes an advance chamber and a retard chamber. The advance chamber exerts a drive hydraulic pressure in an advance operation to rotate an output-side rotor, which drives a camshaft of the internal combustion engine, toward an advance side relative to an input-side rotor, which is driven by a crankshaft of the internal combustion engine. The retard chamber exerts a drive hydraulic pressure in a retard operation to rotate the output-side rotor toward a retard side relative to the input-side rotor. The phase control valve supplies and drains the drive hydraulic pressure relative to the advance chamber and the retard chamber. The hydraulic control arrangement controls hydraulic communication between the variable valve timing mechanism and the phase control valve and includes at least one of a combination of an advance check valve and an advance drain control valve and a combination of a retard check valve and a retard drain control valve. The advance check valve is provided in an advance hydraulic passage, which conducts a control hydraulic pressure of the phase control valve to the advance chamber, to enable hydraulic fluid to flow from the phase control valve to the advance chamber and to limit the hydraulic fluid to flow from the advance chamber to the phase control valve. The advance drain control valve is provided in an advance check valve bypass passage, which bypasses the advance check valve, and is driven by a pilot hydraulic pressure to open and close the advance check valve bypass passage. The retard check valve is provided in a retard hydraulic passage, which conducts the control hydraulic pressure of the phase control valve to the retard chamber, to enable hydraulic fluid to flow from the phase control valve to the retard chamber and to limit the hydraulic fluid to flow from the retard chamber to the phase control valve, and the retard drain control valve is provided in a retard check valve bypass passage, which bypasses the retard check valve, and is driven by a pilot hydraulic pressure to open and close the retard check valve bypass passage. The drain switch valve supplies and drains the pilot hydraulic pressure relative to at least one of the advance drain control valve and the retard drain control valve. The phase control valve and the drain switch valve are integrated together as a complex valve and are driven by a common actuator.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
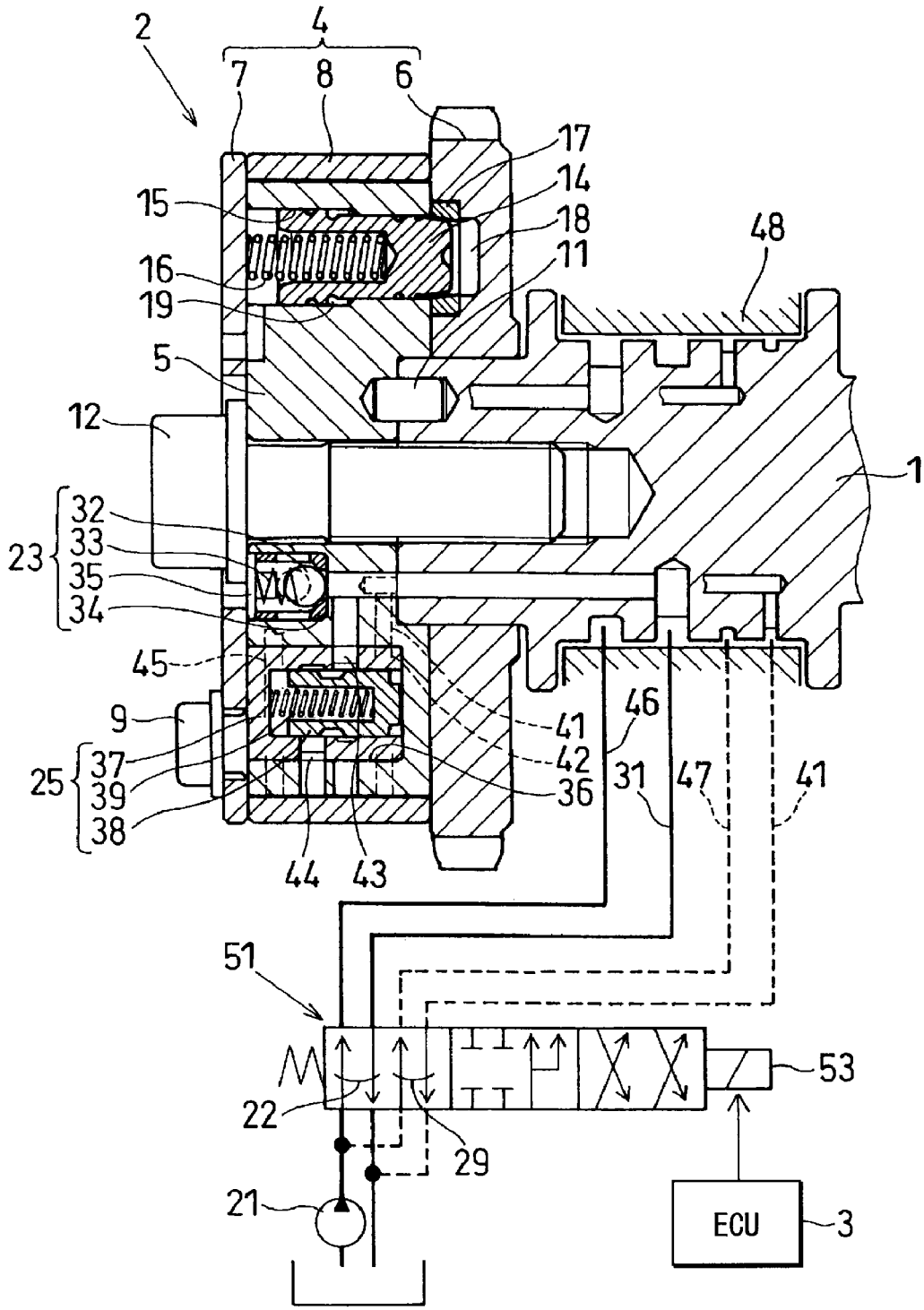
FIG. 1 is a schematic longitudinal cross sectional view showing a VVT system according to a first embodiment of the present invention.

A first embodiment of the present invention will be described with reference to FIGS. 1 to 5.

(Description of VVT System)

A VVT system (i.e., a variable valve timing control system) according to the first embodiment includes a VCT mechanism (i.e., a variable valve timing mechanism) 2, a hydraulic control system and an ECU 3. The VCT mechanism 2 is installed to a camshaft 1 of an internal combustion engine (one of an intake valve camshaft, an exhaust valve camshaft, and an intake/exhaust valve camshaft) to linearly change the timing of opening and closing of at least one of the intake valve(s) and exhaust valve(s). The hydraulic control system hydraulically controls the operation of the VCT mechanism 2. The ECU 3 electrically controls the hydraulic control system.

(Description of VCT Mechanism)

The VCT mechanism 2 includes a housing rotor (an example of an input-side rotor) 4 and a vane rotor (an example of an output-side rotor) 5. The housing rotor 4 is driven to rotate synchronously with the crankshaft of the engine. The vane rotor 5 is rotatable relative to the housing rotor 4 and rotates integrally with the camshaft 1. The vane rotor 5 is rotated relative to the housing rotor 4 by a hydraulic actuator, which is provided inside the housing rotor 4, to change the phase of the camshaft 1 toward the advance side or retard side.

The housing rotor 4 includes a sprocket 6, a generally ring-shaped front plate 7 and a shoe housing 8. The sprocket 6 is driven to rotate by the crankshaft of the engine thorough a timing belt or timing chain. The shoe housing 8 includes an annular peripheral wall, which is axially held between the sprocket 6 and the front plate 7. The front plate 7 and the shoe housing 8 are coupled to the sprocket 6 with a plurality of bolts 9, so that the front plate 7 and the shoe housing 8 rotate together with the sprocket 6.

Figure 2:
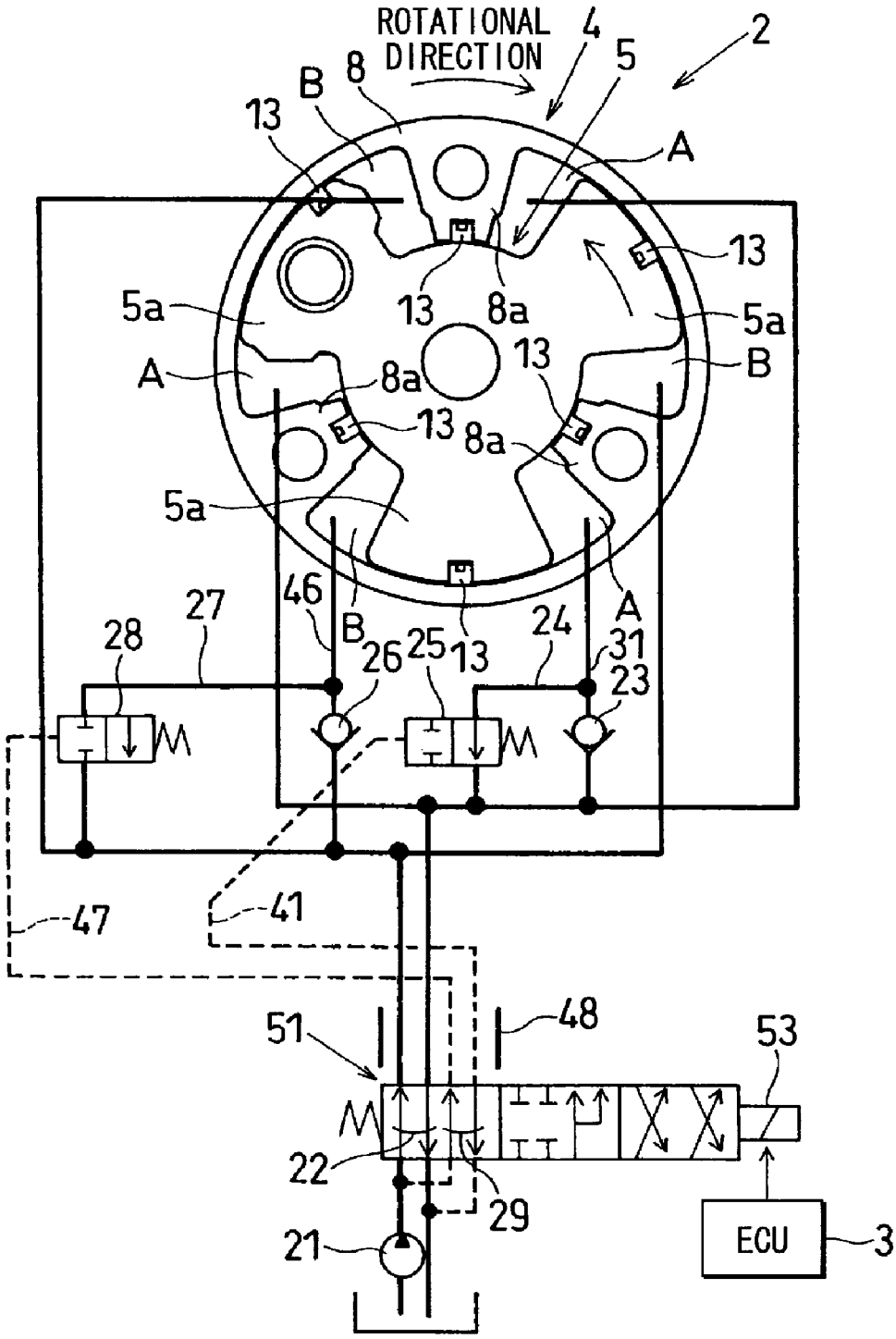
FIG. 2 is a schematic end view showing the VVT system of the first embodiment in a retard operation.
Figure 3:
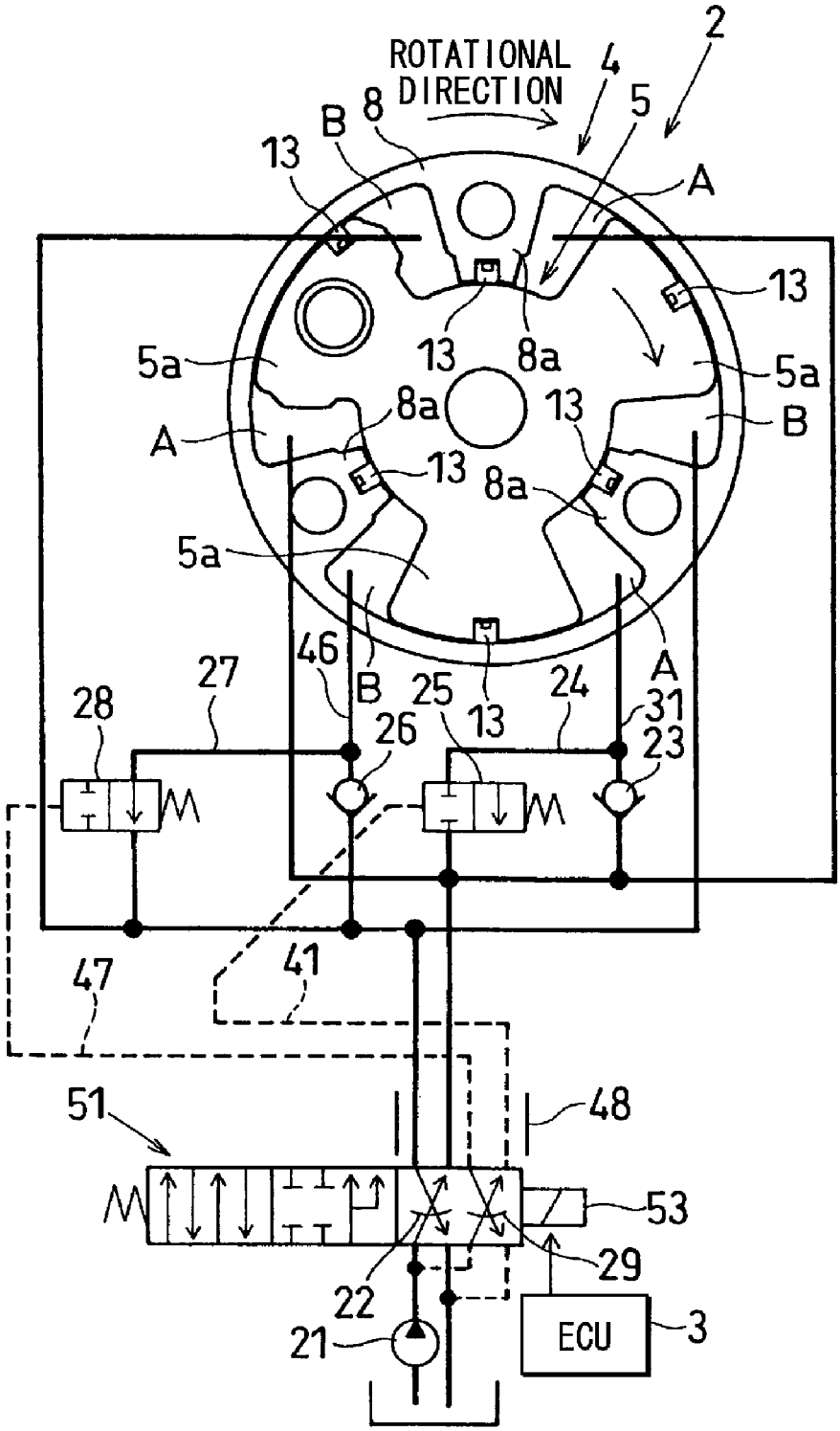
FIG. 3 is a schematic end view showing the VVT system of the first embodiment in an advance operation.

With reference to FIGS. 2 and 3, the shoe housing 8 has a plurality of shoes 8*a* (three shoes 8*a* in this embodiment). The shoes 8*a* serve as partition members and protrude radially inward from the annular peripheral wall to define a generally fan-shaped recess between each adjacent two shoes 8*a*. The housing rotor 4 rotates in a clockwise direction in FIG. 2, and this rotational direction is referred to as the advancing direction in this particular embodiment.

The vane rotor 5 is positioned at one end of the camshaft 1 with a knock pin 11 to rotate integrally with the camshaft 1. Furthermore, the vane rotor 5 is fixed to the end of the camshaft 1 with a center bolt 12, so that the vane rotor 5 rotates integrally with the camshaft 1.

The vane rotor 5 has a plurality of vanes 5*a* (three vanes 5*a* in this embodiment). Each vane 5*a* partitions the corresponding fan-shaped recess, which is defined between the corresponding adjacent two shoes 8*a*, into an advance chamber A and a retard chamber B. The vane rotor 5 is rotatable relative to the housing rotor 4 within a predetermined angular range.

Each advance chamber A is placed on the counterclockwise side of the corresponding vane 5*a* in the corresponding fan-shaped recess to drive the vane 5*a* toward the advance side by the drive hydraulic pressure. Furthermore, each retard chamber B is placed on the clockwise side of the corresponding vane 5*a* in the corresponding fan-shaped recess to drive the vane 5*a* toward the retard side by the drive hydraulic pressure. Each advance chamber A is fluid tightly sealed from its adjacent retard chamber B by, for example, a sealing member 13.

The VCT mechanism 2 further includes a stopper pin 14, which locks the vane rotor 5 against the housing rotor 4 at a most retarded position.

The stopper pin 14 is configured into a generally cylindrical rod shape and is axially slidably received in a stopper receiving hole 15, which has a generally circular cross section and axially penetrates through one of the three vanes 5*a*. The stopper pin 14 is urged toward the sprocket 6 side by a spring 16. In the most retarded position, the stopper pin 14 is fitted into a stopper bush 17, which is securely press fitted into the sprocket 6. A fitting portion of the stopper pin 14 and a fitting portion of the stopper bush 17, which are fitted together, are tapered to permit the smooth fitting of the stopper pin 14 into the stopper bush 17.

A first stopper release fluid chamber 18, which is formed between the tip of the stopper pin 14 (right side end in FIG. 1) and the sprocket 6, communicates with one of the advance chambers A. The hydraulic pressure of the hydraulic fluid, which is supplied to the this advance chamber A, is exerted in the first stopper release fluid chamber 18 to urge the stopper pin 14 toward the left side in FIG. 1, so that the stopper pin 14 is released from the stopper bush 17.

The stopper pin 14 has a large diameter portion on the left side in FIG. 1. A second stopper release fluid chamber 19 is formed between a stepped portion of the stopper pin 14 and the stopper receiving hole 15. The second stopper release fluid chamber 19 communicates with one of the retard chambers B. The hydraulic pressure of the hydraulic fluid, which is supplied to this retard chamber B, is exerted in the second stopper release fluid chamber 19 to urge the stopper pin 14 toward the left side in FIG. 1, so that the stopper pin 14 is released from the stopper bush 17.

(Description of Hydraulic Control System)

The hydraulic control system supplies and discharges the hydraulic fluid to and from the advance chambers A and the retard chambers B to rotate the vane rotor 5 relative to the housing rotor 4 through use of a difference in the hydraulic pressure between the advance chambers A and the retard chambers B. The hydraulic control system includes an oil pump (hydraulic pressure source) 21 and an OCV (i.e., a phase control valve) 22. The oil pump 21 is driven by, for example, the crankshaft. The OCV 22 is switched to supply the hydraulic fluid, which is pumped by the oil pump 21, to the advance chambers A or the retard chambers B.

The hydraulic control system further includes an advance check valve 23, an advance drain control valve 25, a retard check valve 26, a retard drain control valve 28 and an OSV (i.e., a drain switch valve) 29. The advance check valve 23, the advance drain control valve 25, the retard check valve 26 and the retard drain control valve 28 form a hydraulic control arrangement of the present invention, which controls hydraulic communication between the VCT mechanism 2 (more specifically, a corresponding one of the advance chambers A and a corresponding one of the retard chambers B) and the OCV 22. The advance check valve 23 limits the hydraulic fluid to flow back from the one of the advance chambers A to the OCV 22 side. The advance drain control valve 25 opens and closes an advance check valve bypass passage 24, which bypasses the advance check valve 23. The retard check valve 26 limits the hydraulic fluid to flow back from the one of the retard chambers B to the OCV 22. The retard drain control valve 28 opens and closes a retard check valve bypass passage 27, which bypasses the retard check valve 26. The OSV 29 controls the operation of the advance drain control valve 25 and the operation of the retard drain control valve 28.

(Description of Advance Check Valve)

The advance check valve 23 is provided in an advance fluid passage 31, which supplies the hydraulic fluid (control hydraulic pressure) from the OCV 22 to the corresponding advance chamber A. The advance check valve 23 enables the hydraulic fluid to flow from the OCV 22 to the advance chamber A and limits the hydraulic fluid to flow from the advance chamber A to the OCV 22.

The advance check valve 23 is provided in the advance fluid passage 31, which is formed in the vane rotor 5. Furthermore, as shown in FIG. 1, the advance check valve 23 includes a ball 32, a spring 33, a valve seat 34 and a sealing plug 35. The valve seat 34 is formed in the vane rotor 5.

Figure 9:
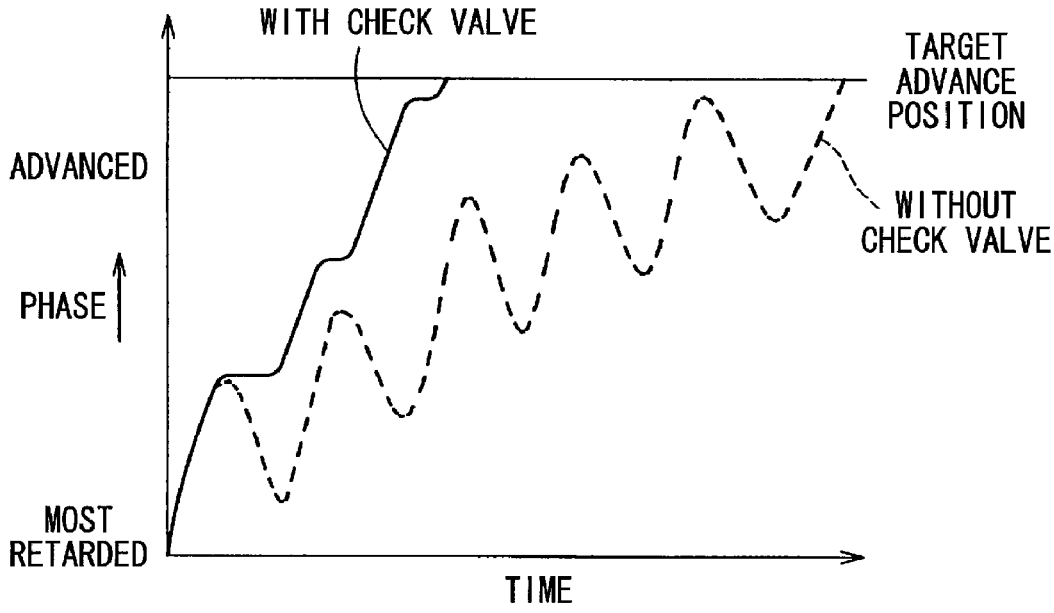
FIG. 9 is a diagram showing a target phase reaching time for a case with a check valve and a case without the check valve.

In the case where the advance check valve 23 is provided in the advance fluid passage 31, at the time of changing the phase of the camshaft 1 from the retard side to the advance side, the vane rotor 5 is not returned toward the retard side by the torque fluctuation. Therefore, the response at the time of changing the phase toward the advance side can be improved (see FIG. 9).

(Description of Advance Drain Control Valve)

The advance check valve bypass passage 24 is formed in the vane rotor 5. The advance check valve bypass passage 24 bypasses the advance check valve 23 and conducts the hydraulic fluid.

The advance drain control valve 25 is a spool valve that is provided in a drain control valve receiving hole 36, which axially penetrates through one of the vanes 5*a* and has a generally circular cross section. As shown in FIG. 1, the advance drain control valve 25 includes a sleeve 37, a spool 38 and a spring 39. The sleeve 37 is press fitted into the drain control valve receiving hole 36, and the spool 38 is axially slidably received in the sleeve 37. The spring 39 urges the spool 38 in a valve opening direction (a direction for opening the advance check valve bypass passage 24).

A signal port 42, first and second opening/closing ports 43, 44 and a drain port 45 of a spring chamber are formed in the sleeve 37 of the advance drain control valve 25. A pilot hydraulic pressure (a drive hydraulic pressure that drives the spool 38) is supplied from the OSV 29 to the signal port 42 through an advance pilot passage 41 and is also discharged from the signal port 42 through the pilot passage 41. The first and second opening/closing ports 43, 44 are communicated with the advance check valve bypass passage 24. When the pilot hydraulic pressure is applied to the signal port 42, the spool 38 is moved to a blocking position for blocking the communication between the first and second opening/closing ports 43, 44 (a position for blocking the advance check valve bypass passage 24). In contrast, when the pilot hydraulic pressure is discharged from the signal port 42, the spool 38 is moved by the urging force of the spring 39 to a communicating position for communicating between the first and second opening/closing ports 43, 44 (a position for opening the advance check valve bypass passage 24).

(Description of Retard Check Valve)

The retard check valve 26 is provided in a retard fluid passage 46, which conducts the control hydraulic pressure from the OCV 22 to the corresponding retard chamber B. The retard check valve 26 enables the hydraulic fluid to flow from the OCV 22 to the retard chamber B and blocks the hydraulic fluid to flow from the retard chamber B to the OCV 22.

The retard check valve 26 is provided in the retard fluid passage 46, which is formed in the vane rotor 5 and has a structure similar to that of the advance check valve 23.

In the case where the retard check valve 26 is provided in the retard fluid passage 46, at the time of changing the phase of the camshaft 1 from the advance side to the retard side, the vane rotor 5 is not returned toward the advance side by the torque fluctuation. Therefore, the response at the time of changing the phase toward the retard side can be improved.

(Description of Retard Drain Control Valve)

The retard check valve bypass passage 27 is formed in the vane rotor 5. The retard check valve bypass passage 27 bypasses the retard check valve 26 and conducts the hydraulic fluid.

The retard drain control valve 28 is a spool valve that is provided in a drain control valve receiving hole (not shown), which axially penetrates through one of the vanes 5*a* and has a generally circular cross section. The retard drain control valve 28 has a structure similar to that of the advance drain control valve 25. When the pilot hydraulic pressure is applied from the OSV 29 through a retard pilot passage 47, the retard drain control valve 28 blocks the retard check valve bypass passage 27. In contrast, when the pilot hydraulic pressure is discharged through the retard pilot passage 47, the retard drain control valve 28 opens the retard check valve bypass passage 27.

The advance fluid passage 31, which conducts the control hydraulic pressure (drive hydraulic pressure) from the OCV 22 to the advance chamber A, and the retard fluid passage 46, which conducts the control hydraulic pressure (drive hydraulic pressure) from the OCV 22 to the retard chamber B, are communicated with the OCV 22 through a cam journal 48, which rotatably supports the camshaft 1. Also, the advance pilot passage 41, which conducts the control hydraulic pressure (pilot hydraulic pressure) from the OSV 29 to the advance drain control valve 25, and the retard pilot passage 47, which conducts the control hydraulic pressure (pilot hydraulic pressure) from the OSV 29 to the retard drain control valve 28, are communicated with the OSV 29 through the cam journal 48.

(Description of OCV and OSV)

The OCV 22 and the OSV 29 of the first embodiment have the following characteristics.

(1) The OCV 22 and the OSV 29 are integrated together as a solenoid spool valve (a single complex valve) 51, which is driven by a common actuator (a solenoid actuator, or an electromagnetic actuator 53 described below).

(2) A valve element of the OCV 22 and a valve element of the OSV 29 are integrated together as a spool 55, which is described latter.

(3) The OCV 22 is provided on an open air side (an engine head side from which the hydraulic fluid is discharged) of the OSV 29.

(4) A drain port, through which the drive hydraulic pressure is drained on the OCV 22 side, and a drain port, through which the pilot hydraulic pressure is drained on the OSV 29 side, share a common portion (ports 61, 65 described below).

(5) There is provided a pressure pulsation transmission limiting means for limiting transmission of the hydraulic pressure fluctuation of the drain system (ports 61, 62, 64, 65, 69, 71) of the OCV 22 to the drain system (ports 61, 65, 66, 68, 69, 72) of the OSV 29.

(Description of Solenoid Spool Valve)

Next, a specific structure of the solenoid spool valve 51, in which the OCV 22 and the OSV 29 are integrated together, will be described with reference to FIG. 4 (as well as FIG. 5).

In the solenoid spool valve 51, a spool valve 52 and the electromagnetic actuator 53 are connected together, so that the solenoid spool valve 51 serves as a hydraulic pressure control valve, which has the functions of the OCV 22 and of the OSV 29.

(Description of Spool Valve)

The spool valve 52 includes a sleeve 54, a spool 55 and a return spring 56. In the present embodiment, the left side of the spool valve 52 in FIG. 4 implements the function of the OCV 22, and the right side of the spool valve 52 in FIG. 4 implements the function of the OSV 29.

The sleeve 54 is formed into a generally cylindrical body and is installed and is fixed to, for example, the engine head (an exemplary member, to which the solenoid spool valve 51 is installed and which may be alternatively a component that forms a fluid passage and is installed to the engine). A receiving through hole is formed in the sleeve 54 to axially slidably receive the spool 55.

Figure 4:
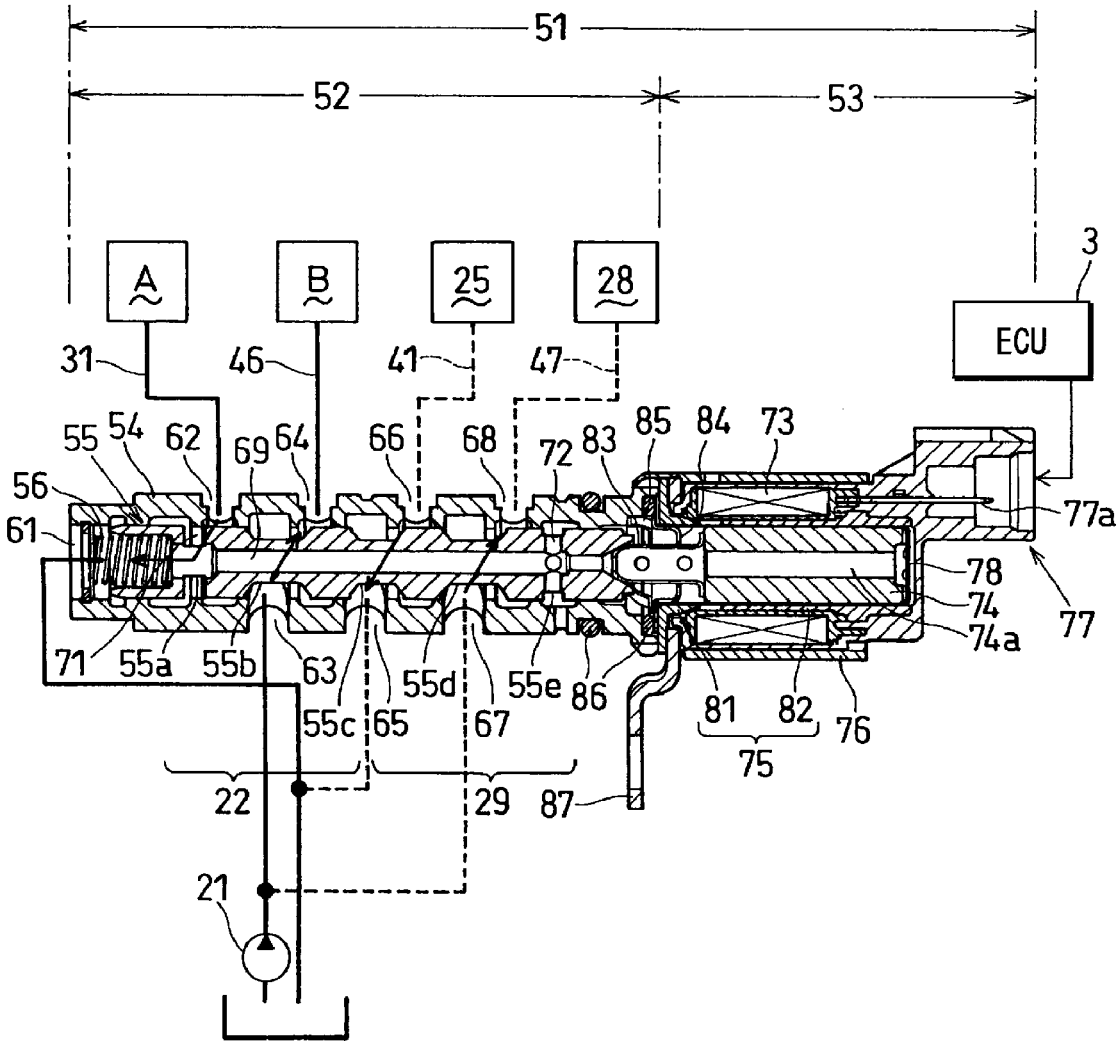
FIG. 4 is a longitudinal cross sectional view showing a solenoid spool valve of the first embodiment in the retard operation.

A first drain port 61, an advance chamber output port 62, an OCV input port 63, a retard chamber output port 64, a second drain port 65, an advance pilot port 66, an OSV input port 67 and a retard pilot port 68 are formed in the sleeve 54 in this order from the left side to the right side in FIG. 4. The first drain port 61 opens to the interior of the engine head. The advance chamber output port 62 is communicated with the advance chamber A through the advance check valve 23. The OCV input port 63 is communicated with an oil outlet of the oil pump 21. The retard chamber output port 64 is communicated with the retard chamber B through the retard check valve 26. The second drain port 65 returns the hydraulic fluid into the engine head through a hydraulic fluid passage formed in the engine head (or the other component as mentioned above). The advance pilot port 66 is communicated with the signal port of the advance drain control valve 25. The OSV input port 67 is communicated with the oil outlet of the oil pump 21. The retard pilot port 68 is communicated with the signal port of the retard drain control valve 28.

The spool 55 has six large diameter parts (lands), each of which has an outer diameter that generally coincides with an inner diameter of the sleeve 54 (an inner diameter of the receiving through hole). These six large diameter parts of the spool 55 are referred to as first to sixth lands from the left side to the right side in FIG. 4. Each of small diameter parts, which change a communication state of the corresponding input/output ports, is provided between corresponding adjacent two of the first to sixth lands. More specifically, first to fifth small diameter parts 55*a*-55*e* are arranged in this order from the left side to the right side in FIG. 4.

An axial drain port 69 extends through the spool 55 along the axis of the spool 55. The left end of the axial drain port 69 in FIG. 4 is communicated with the first drain port 61 through a spring chamber, which receives the return spring 56. The right end of the axial drain port 69 in FIG. 4 is communicated with an interior of a shaft 83, which will be described latter.

A bottom of the first small diameter part 55*a* is communicated with the axial drain port 69 through a third drain port 71, which is formed in the spool 55. As shown in FIG. 4, when the hydraulic pressure is supplied to the retard chambers B, the advance chamber output port 62 is in communication with the first drain port 61 through the third drain port 71 and the axial drain port 69 to discharge the hydraulic pressure from the advance chambers A.

The second small diameter part 55*b* selectively conducts the hydraulic pressure from the OCV input port 63 to one of the advance chamber output port 62 and the retard chamber output port 64 to supply the drive hydraulic pressure to the advance chambers A or the retard chambers B.

As shown in FIG. 4, when the hydraulic pressure is supplied to the retard chambers B, the third small diameter part 55*c* communicates between the advance pilot port 66 and the second drain port 65 to discharge the pilot hydraulic pressure from the advance drain control valve 25. Furthermore, as shown in FIG. 5, when the hydraulic pressure is supplied to the advance chambers A, the third small diameter part 55*c* communicates between the retard chamber output port 64 and the second drain port 65 to discharge the hydraulic pressure from the retard chambers B.

The fourth small diameter part 55*d* selectively conducts the hydraulic pressure from the OSV input port 67 to one of the signal port of the advance drain control valve 25 and the signal port of the retard drain control valve 28.

A bottom of the fifth small diameter part 55*e* is communicated with the axial drain port 69 through a fourth drain port 72, which is formed in the spool 55. As shown in FIG. 5, when the hydraulic pressure is supplied to the advance chambers A, the retard pilot port 68 is in communication with the first drain port 61 through the fourth drain port 72 and the axial drain port 69 to discharge the pilot hydraulic pressure from the retard drain control valve 28.

The return spring 56 is a compressed coil spring that urges the spool 55 toward the right side in FIG. 4. The return spring 56 is placed in the spring chamber at the left side of the sleeve 54 in FIG. 4 in an axially compressed state between the spool 55 and a spring seat, which is installed to the axial end of the sleeve 54.

(Description of Electromagnetic Actuator)

The electromagnetic actuator 53 includes a coil 73, a plunger 74, a stator 75, a yoke 76 and a connector 77.

The coil 73 serves as a means for generating a magnetic force that magnetically attracts the plunger 74 upon energization. An insulated lead wire (enameled wire or the like) is would around a resin bobbin to form the coil 73.

The plunger 74 is a cylindrical body, which is made of magnetic metal (e.g., iron that is a ferromagnetic material for forming a magnetic circuit) that can be magnetically attracted to a magnetically attractive stator 81, which will be described latter. The plunger 74 is axially slidably supported in the stator 75 (specifically, in a cup guide 78 that is provided for hydraulic fluid sealing purpose).

The stator 75 includes the magnetically attractive stator 81 and a magnetic coupling stator 82. The magnetically attractive stator 81 magnetically attracts the plunger 74 in the axial direction. The magnetic coupling stator 82 covers an outer peripheral surface of the cup guide 78 and couples a magnetic flux relative to a peripheral part around the plunger 74.

The magnetically attractive stator 81 is made of magnetic metal (e.g., iron that is a ferromagnetic material for forming a magnetic circuit) and includes a ring-shaped part and an attractive tubular part. The ring-shaped part is held between the sleeve 54 and the coil 73. The attractive tubular part conducts a magnetic flux of the ring-shaped part to a location adjacent to the plunger 74. A magnetic attractive gap (a main gap) is axially formed between the plunger 74 and the attractive tubular part. The attractive tubular part can be axially overlapped with the plunger 74. An end of the attractive tubular part is tapered to limit a change in the magnetic attractive force with respect to an amount of stroke of the plunger 74.

The magnetic coupling stator 82 is made of magnetic metal (e.g., iron that is a ferromagnetic material for forming a magnetic circuit) and includes a stator tubular part and a stator flange. The stator tubular part is received in the bobbin. The stator flange extends radially outward from the stator tubular part and is magnetically coupled with the yoke 76, which is placed radially outward of the stator flange. A magnetic flux coupling gap (a side gap) is radially formed between the stator tubular part and the plunger 74.

The yoke 76 is made of magnetic metal (e.g., iron that is a ferromagnetic material for forming a magnetic circuit) and is formed into a cylindrical body that surrounds the coil 73. Claws of the yoke 76, which are provided at the left end of the yoke 76 in FIG. 4, are bent against the sleeve 54 to couple with the sleeve 54.

The connector 77 is a coupling component formed as a secondary resin molded product, which is formed, for example, by resin molding over the coil 73. Connector terminals 77*a*, which are connected to terminal ends of the coil 73, are placed in the interior of the connector 77. One ends of the connector terminals 77*a* are exposed in the interior of the connector 77, and the other ends of the connector terminals 77*a* are received in the bobbin and are resin molded in the secondary molded resin.

The solenoid spool valve 51 includes the shaft 83. The shaft 83 conducts a drive force of the plunger 74, which is exerted toward the left side in FIG. 4, to the spool 55. Also, the shaft 83 conducts an urging force of the return spring 56, which is applied to the spool 55, to the plunger 74.

The shaft 83 is a hollow, cup-shaped component, which is made from a non-magnetic metal plate (e.g., a stainless steel plate). A variable volume part, which is formed around the shaft 83, is communicated with the axial drain port 69 of the spool 55 through holes, which penetrate through a peripheral wall of the shaft 83, and an interior space of the shaft 83. The interior of the shaft 83 is also communicated with a variable volume part, which is located on the right side of the plunger 74 in FIG. 4, through a breathing path 74*a* that extends through the plunger 74 along the axis of the plunger 74.

A magnetic opposing member 84, which is made of magnetic metal, is inserted in the magnetically attractive stator 81 on the left side of the cup guide 78 in FIG. 4. The magnetic opposing member 84 is magnetically coupled with the magnetically attractive stator 81 to increase the magnetic attractive force of the plunger 74. The magnetic opposing member 84 is fixed in place by a leaf spring 85, which is made of non-magnetic metal (e.g., a stainless steel plate).

Reference numeral 86 in FIG. 4 denotes an O-ring for sealing, and reference numeral 87 denotes a bracket for fixing the solenoid spool valve 51 to the engine head or the like.

(Description of ECU)

The ECU 3 is constructed as a known computer. The ECU 3 performs a VVT control operation for executing duty ratio control of amount of supplied electric current (a supply amount of electric current) of the coil 73 based on the operational state of the engine (including an operational state of a vehicle occupant), which is obtained through, for example, sensors, and a corresponding program stored in a memory. When the amount of supplied electric current of the coil 73 is controlled by the ECU 3, the position of the spool 55 is controlled, so that the hydraulic pressure in the advance chambers A and the hydraulic pressure in the retard chambers B are controlled to control the advance phase of the camshaft 1 to a corresponding advance phase, which corresponds to the current engine operational state.

(Description of Operation of VVT System)

When the engine is stopped, the stopper pin 14 is fitted in the stopper bush 17. Right after the engine start, the sufficient hydraulic pressure is not yet supplied from the oil pump 21 to each fluid chamber. Thus, the pin 14 remains fitted in the stopper bush 17, and thereby the camshaft 1 is held in the most retarded position. Therefore, until the sufficient hydraulic pressure is supplied to the hydraulic chamber, the housing rotor 4 and the vane rotor 5 are limited from oscillating and colliding with each other, which would be caused by torque fluctuation applied to the camshaft 1.

After the engine start, when the sufficient hydraulic pressure is supplied from the oil pump 21, the hydraulic pressure supplied to the first or second stopper release fluid chamber 18, 19 causes release of the stopper pin 14 from the stopper bush 17. Thus, the vane rotor 5 can now rotate relative to the housing rotor 4. When the hydraulic pressure of the advance chambers A becomes larger than that of the retard chambers B, the vane rotor 5 is rotated toward the advance side relative to the housing rotor 4, so that the camshaft 1 is advanced. In contrast, when the hydraulic pressure of the retard chambers B becomes larger than that of the advance chambers A, the vane rotor 5 is rotated toward the retard side relative to the housing rotor 4, so that the camshaft 1 is retarded.

(Description of Control Operation for Rotating Vane Rotor in Retarding Direction)

When the solenoid spool valve 51 is turned off (when the amount of stroke of the spool 55 is zero), the spool 55 is placed in the position shown in FIG. 4 by the urging force of the return spring 56.

This state will be described in detail.

In this state, the signal port of the retard drain control valve 28 is communicated with the OSV input port 67, and the retard check valve bypass passage 27 is blocked.

The retard chamber B is communicated with the OCV input port 63 through the retard check valve 26, so that the drive hydraulic pressure is supplied to the retard chamber B.

On the other hand, the signal port of the advance drain control valve 25 is communicated with the second drain port 65, and the advance check valve bypass passage 24 is opened.

The advance chamber A is communicated with the first drain port 61 through the third drain port 71 and the axial drain port 69, so that the hydraulic pressure is discharged from the advance chamber A through the advance check valve bypass passage 24.

Thus, the drive hydraulic pressure is supplied to the retard chambers B, and the hydraulic pressure is discharged from the advance chambers A. Therefore, the vane rotor 5 is rotated toward the retard side relative to the housing rotor 4, so that the camshaft 1 is retarded.

When the amount of advance of the camshaft 1 is controlled to the target phase on the retard side, the vane rotor 5 receives the torque fluctuation toward the retard side and the advance side relative to the housing rotor 4. The torque fluctuation, which is applied to the vane rotor 5 toward the advance side, forces the hydraulic pressure in the retard chambers B toward the supply side (the OCV 22 side). However, the retard check valve 26 is provided in the retard fluid passage 46, and retard check valve bypass passage 27 is blocked by the retard drain control valve 28. Thus, the hydraulic pressure in the retard chambers B is not forced by the torque fluctuation to drain out of the retard chambers B toward the supply side (the OCV 22 side). Thus, even when the vane rotor 5 receives the torque fluctuation toward the advance side in the state where the hydraulic pressure supplied from oil pump 21 is still relatively low, the vane rotor 5 is not pushed backward toward the advance side. Therefore, the response of the vane rotor 5 for reaching the target phase is improved.

(Description of Control Operation for Rotating Vane Rotor in Advancing Direction)

Figure 5:
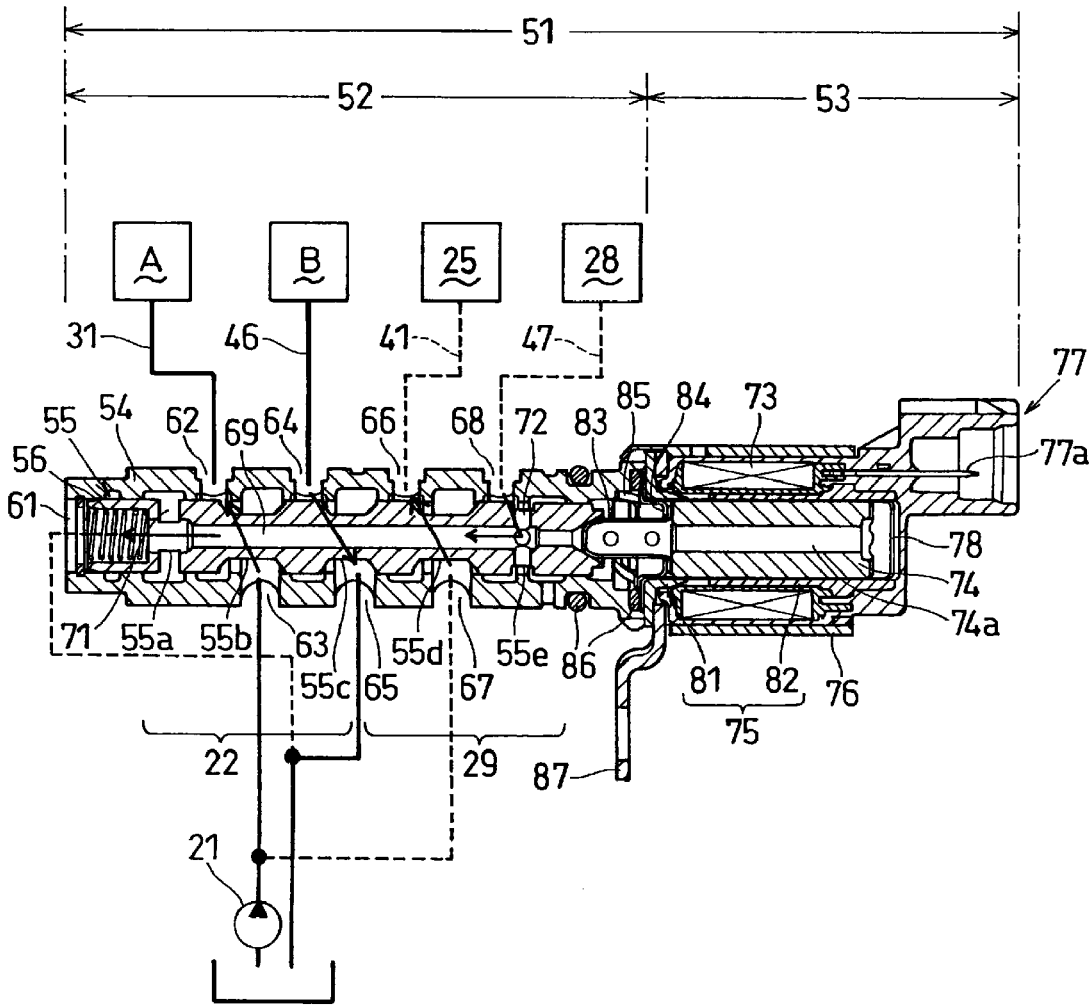
FIG. 5 is a longitudinal cross sectional view showing the solenoid spool valve of the first embodiment in the advance operation.

When the solenoid spool valve 51 is turned on (when the amount of stroke of the spool 55 is full stroke), the spool 55 is placed in the position shown in FIG. 5 by action of the electromagnetic actuator 53.

This state will be described in detail.

In this state, the signal port of the retard drain control valve 28 is communicated with the first drain port 61 through the fourth drain port 72 and the axial drain port 69, and thereby the retard check valve bypass passage 27 is opened.

The retard chamber B is communicated with the second drain port 65, so that the hydraulic pressure is discharged from the retard chamber B through the retard check valve bypass passage 27.

The signal port of the advance drain control valve 25 is communicated with the OSV input port 67, so that the advance check valve bypass passage 24 is blocked.

The advance chamber A is communicated with the OCV input port 63 through the advance check valve 23, so that the drive hydraulic pressure is supplied to the advance chamber A.

Thus, the drive hydraulic pressure is supplied to the advance chamber A, and the hydraulic pressure is discharged from the retard chamber B. Thereby, the vane rotor 5 is rotated toward the advance side relative to the housing rotor 4. As a result, the camshaft 1 is advanced.

When the amount of advance of the camshaft 1 is controlled to the target phase on the advance side, the vane rotor 5 receives the torque fluctuation toward the retard side and the advance side relative to the housing rotor 4. The torque fluctuation, which is applied to the vane rotor 5 toward the retard side, forces the hydraulic pressure in the advance chambers A toward the supply side (the OCV 22 side). However, the advance check valve 23 is provided in the advance fluid passage 31, and advance check valve bypass passage 24 is blocked by the advance drain control valve 25. Thus, the hydraulic pressure in the advance chambers A is not forced by the torque fluctuation to drain out of the advance chambers A toward the supply side (the OCV 22 side). Thus, even when the vane rotor 5 receives the torque fluctuation toward the retard side in the state where the hydraulic pressure discharged from oil pump 21 is still relatively low, the vane rotor 5 is not pushed backward toward the retard side. Therefore, the response of the vane rotor 5 for reaching the target phase is improved.

(Description of Maintenance of Amount of Advance)

When the vane rotor 5 reaches the target phase, the ECU 3 executes duty ratio control of the amount of supplied electric current of the electromagnetic actuator 53 to maintain or sustain the spool 55 in the middle position, which is between the position of FIG. 4 and the position of FIG. 5 (in the state at which the amount of stroke of the spool 55 is ½).

This state will be described in detail.

In this state, the signal port of the retard drain control valve 28 is communicated with the OSV input port 67, and the retard check valve bypass passage 27 is blocked.

The retard chamber output port 64 is closed with the third land, so that the hydraulic pressure of the retard chambers B is maintained.

The signal port of the advance drain control valve 25 is communicated with the OSV input port 67, so that the advance check valve bypass passage 24 is blocked.

The advance chamber output port 62 is closed with the second land, so that the hydraulic pressure of the advance chambers A is maintained.

In this way, the drive hydraulic pressure of the advance chambers A and the drive hydraulic pressure of the retard chambers B are maintained, so that the vane rotor 5 is maintained at the target phase.

Advantages of First Embodiment

As described above, the VVT system of the first embodiment has the single solenoid spool valve 51, which includes both of the OCV 22 for supplying the drive hydraulic pressure to the advance chambers A or the retard chambers B and the OSV 29 for controlling the opening and closing of the advance and retard drain control valves 25, 28.

The OCV 22 and the OSV 29 therefore work with each other reliably and precisely, so that the reliability of a VVT system that includes two drain control valves 25, 28 is improved.

Being one solenoid spool valve 51, the OCV 22 and OSV 29 are mounted on the engine head or the like with fewer process steps, and take up less mounting space, so that mountability of the OCV 22 and the OSV 29 to the engine is improved.

Also, the number of components for the OCV 22 and the OSV 29 united as one solenoid spool valve 51 is fewer than separate OCV and OSV, so that the cost for providing these valves is reduced. Therefore, the cost of the VVT system can be reduced.

As described above in the above section (2), the OCV 22 and the OSV 29 of the VVT system according to the first embodiment share one spool 55 as their valve element.

Thereby, fewer components are needed than providing separate valve elements for both of the OCV and the OSV.

As discussed in the above section (3), the OCV 22 is provided on the open air side (the engine head side from which the hydraulic fluid is discharged) of the OSV 29.

Since the OCV 22, which discharges the greater amount of hydraulic fluid, is positioned on the open air side, the pressure loss of the hydraulic fluid discharged from the OCV 22 can be reduced, and the drain performance of the OCV 22 can be improved.

In this embodiment, in particular, the first drain port 61 of the sleeve 54, which is located at the left end in FIG. 4, opens into the engine head. Thus, the pressure loss of the hydraulic fluid, which is discharged from the advance chambers A, can be minimized. Therefore, the advancing speed can be improved. The first drain port 61 has a relatively large effective port diameter to reduce the pressure loss of the hydraulic fluid. Specifically, the inner diameter of the hole of the spring seat, which supports the return spring 56, is set to be relatively large.

As discussed above in the above section (4), in the VVT system of the first embodiment, the drain port, through which the drive hydraulic pressure is drained on the OCV 22 side, and the drain port, through which the pilot hydraulic pressure is drained on the OSV 29 side, share the common portion.

More specifically, as discussed above, the second drain port 65 is the common drain port, which is common to the OCV 22 and the OSV 29. Furthermore, the first drain port 61 is the common drain port, which is common to the OCV 22 and the OSV 29.

Thus, when the first drain port 61 and the second drain port 65 are shared by the OCV 22 and the OSV 29, the axial length of the spool 52 can be reduced, and thereby the size of the solenoid spool valve 51 can be reduced.

As discussed in the above section (5), the VVT system of the first embodiment has the pressure pulsation transmission limiting means for limiting the transmission of the hydraulic pressure fluctuation of the drain system of the OCV 22 to the drain system of the OSV 29.

More specifically, the pressure pulsation transmission limiting means of the first embodiment is a drain separating means for discharging the hydraulic pressure from the drain system of the OCV 22 and the hydraulic pressure from the drain system of the OSV 29 through the different drain ports in the advance operation and also for discharging the hydraulic pressure from the drain system of the OCV 22 and the hydraulic pressure from the drain system of the OSV 29 through the different drain ports in the retard operation.

Specifically, as shown in FIG. 4, during the retard operation, the hydraulic pressure of the advance chambers A is discharged from the first drain port 61 through the axial drain port 69, and the pilot hydraulic pressure of the advance drain control valve 25 is discharged from the second drain port 65.

Furthermore, as shown in FIG. 5, during the advance operation, the hydraulic pressure of the retard chambers B is discharged from the second drain port 65, and the pilot hydraulic pressure of the retard drain control valve 28 is discharged from the first drain port 61 through the axial drain port 69.

The pressure pulsation transmission limiting means (drain separating means) limits the transmission of the hydraulic pressure fluctuation, which occurs in the drain system of the OCV 22, to the drain system of the OSV 29. Thus, the operational performance of the advance drain control valve 25 and the operational performance of the retard drain control valve 28 can be improved.

Second Embodiment

A second embodiment of the present invention will be described with reference to FIGS. 6 and 7. In the following description, the components similar to those discussed in the first embodiment will be indicated by the similar reference numerals.

First Characteristic of Second Embodiment

The solenoid spool valve 51 of the first embodiment includes the first drain port 61 and the second drain port 65 as the drain ports for discharging the hydraulic fluid.

In contrast, the solenoid spool valve 51 of the second embodiment discharges the hydraulic fluid only from the first drain port 61. That is, in the second embodiment, only the one drain port for discharging the hydraulic fluid out of the solenoid spool valve 51 is shared.

Each drain system of the solenoid spool valve 51 of the second embodiment will now be described.

The advance chamber output port 62 can communicate with the axial drain port 69 through the third drain port 71, which radially extends through the spool 55.

The retard chamber output port 64 can communicate with the axial drain port 69 through a fifth drain port 91, which radially extends through the spool 55.

The advance pilot port 66 can communicate with the axial drain port 69 through a sixth drain port 92, which radially extends through the spool 55.

The retard pilot port 68 can communicate with the axial drain port 69 through the fourth drain port 72, which radially extends through the spool 55.

Figure 6:
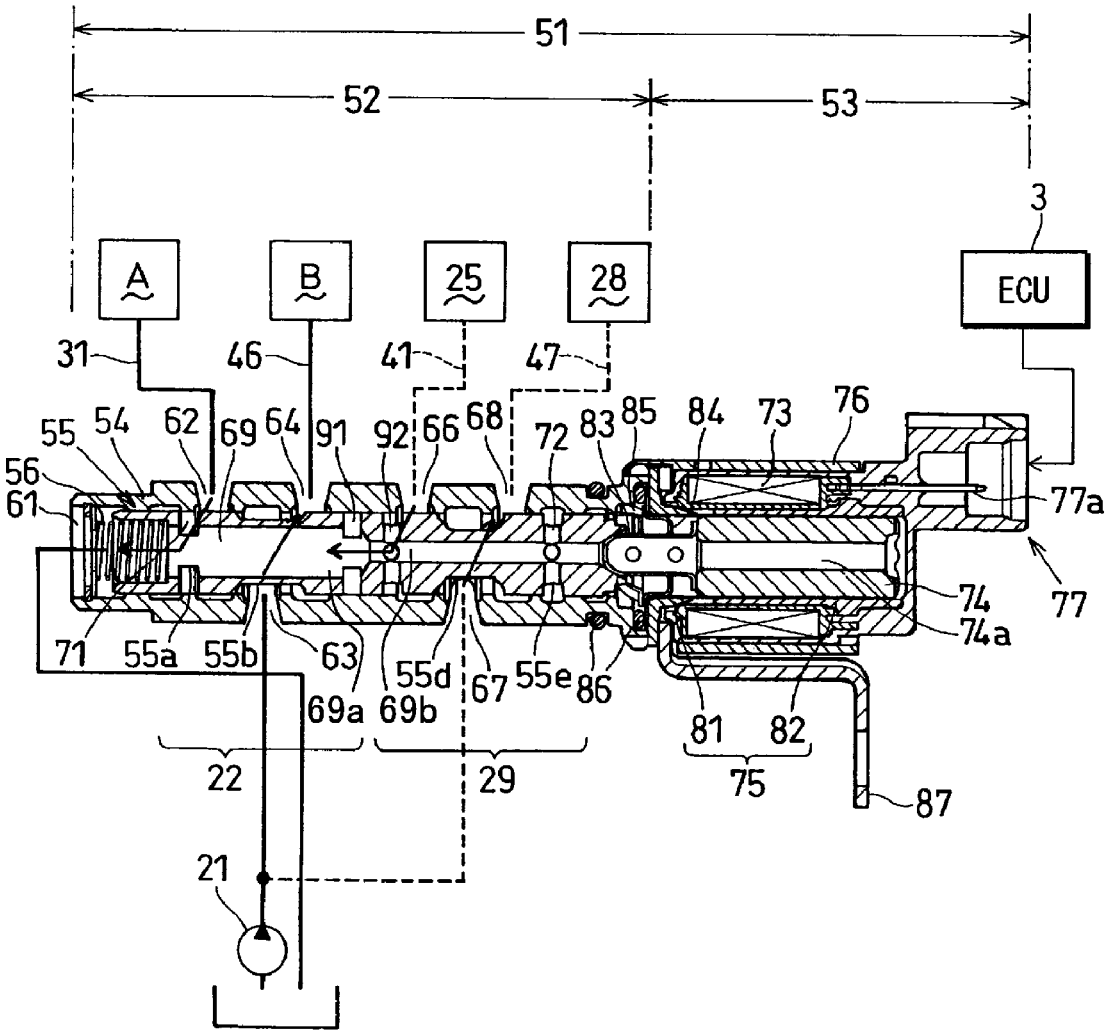
FIG. 6 is a longitudinal cross sectional view showing a solenoid spool valve of a second embodiment in a retard operation.

Thus, in the retard operation (the OFF period of the electromagnetic actuator 53), as shown in FIG. 6, the advance chamber output port 62 is communicated with the axial drain port 69 through the third drain port 71 to discharge the hydraulic fluid of the advance chambers A from the first drain port 61. Also, at this time, the advance pilot port 66 is communicated with the axial drain port 69 through the sixth drain port 92 to discharge pilot hydraulic pressure of the advance drain control valve 25 from the first drain port 61.

Figure 7:
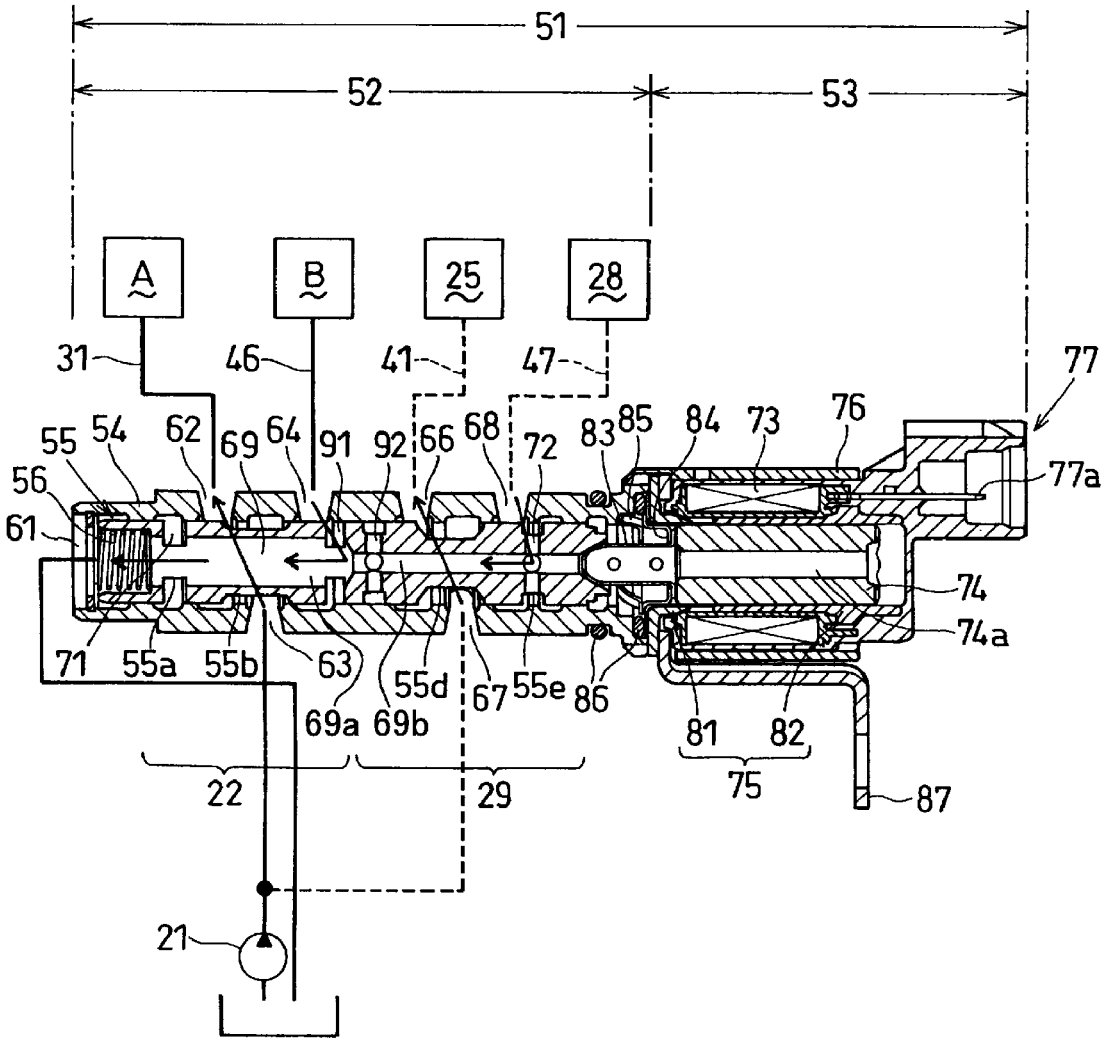
FIG. 7 is a longitudinal cross sectional view showing the solenoid spool valve of the second embodiment in an advance operation.
Figure 8:
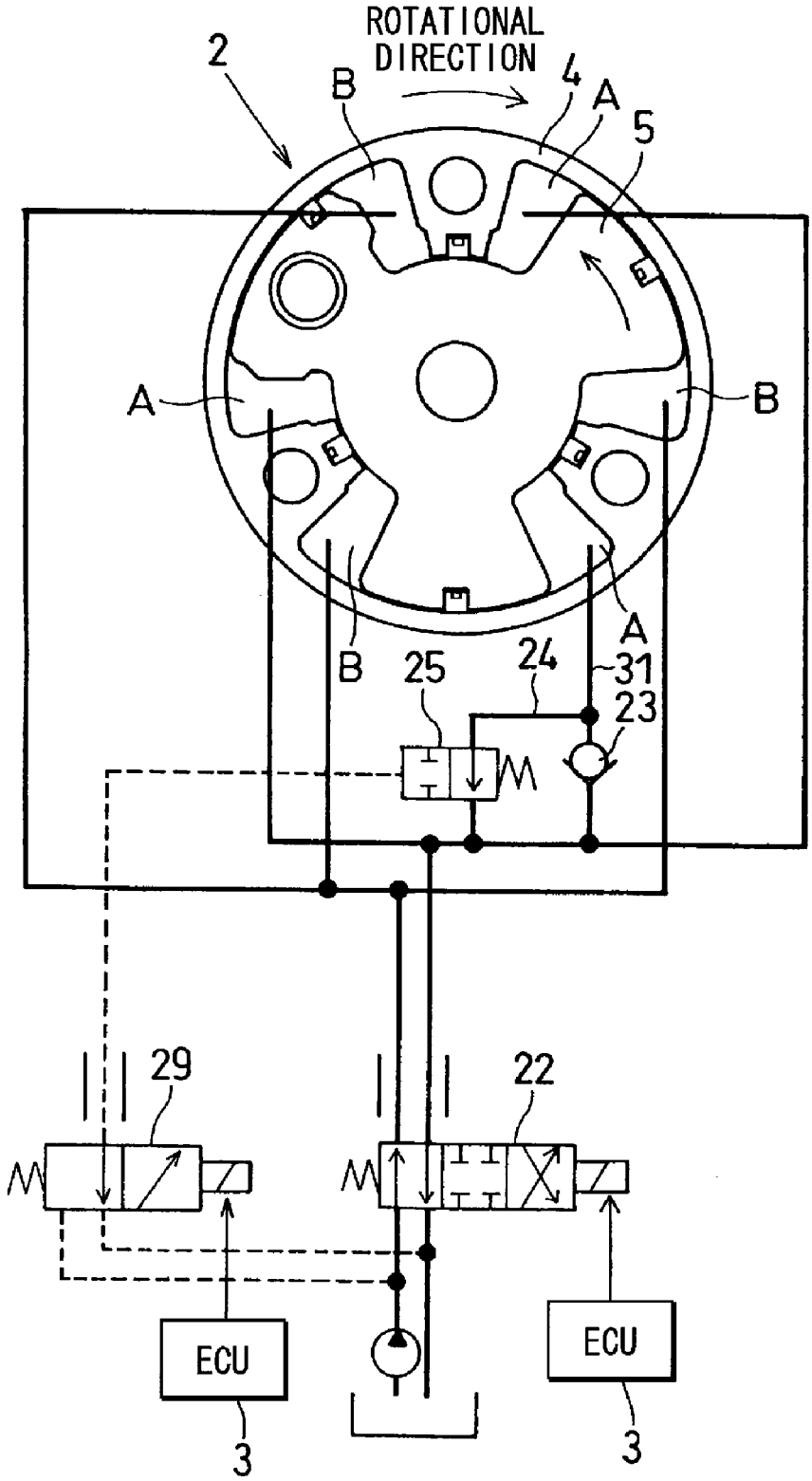
FIG. 8 RELATED ART
FIG. 8 is a schematic end view showing a previously proposed VVT system.

Furthermore, in the advance operation (the ON period of the electromagnetic actuator 53), as shown in FIG. 7, the retard chamber output port 64 is communicated with the axial drain port 69 through the fifth drain port 91 to discharge the hydraulic fluid of the retard chambers B from the first drain port 61. Also, at this time, the retard pilot port 68 is communicated with the axial drain port 69 through the fourth drain port 72 to discharge pilot hydraulic pressure of the retard drain control valve 28 from the first drain port 61.

As discussed above, there is only the one drain port, i.e., the first drain port 61 for discharging the hydraulic fluid out of the solenoid spool valve 51, so that the number of the drain ports for discharging the hydraulic fluid out of the solenoid spool valve 51 is minimized. As a result, the axial dimension of the spool valve 52 can be further reduced in comparison to the first embodiment.

Particularly, since the first drain port 61 directly opens into the engine head, there is no need to provide an additional oil passage for draining purposes in the component (e.g., the engine head), in which the sleeve 54 is inserted. Therefore the processing cost of the component, in which the solenoid spool valve 51 is mounted, can be reduced.

Second Characteristic of Second Embodiment

Furthermore, in the second embodiment, the pressure pulsation transmission limiting means for limiting the transmission of the hydraulic pressure fluctuation from the drain system of the OCV 22 to the drain system of the OSV 29 is different from that of the first embodiment.

In the second embodiment, as discussed above, the drain system (ports 61, 62, 64, 69, 71, 91) of the OCV 22 and the drain system (ports 61, 66, 68, 69, 72, 92) of the OSV 29 discharge the hydraulic fluid from the common drain port, i.e., the first drain port 61.

Therefore, in the pressure pulsation transmission limiting means of the second embodiment, similarly to the first embodiment, the drain system of the OCV 22 is positioned closer to the first drain port 61, which is on the open air side of the drain system of the OSV 29. Furthermore, the first drain port 61 of the sleeve 54 at the left end in FIG. 6 is opened into the engine head. Also, the hydraulic fluid passage diameter of the drain system of the OCV 22 is made larger, while that of the OSV 29 is made smaller. More specifically, an inner diameter of a part (a hydraulic fluid passage part) 69*a* of the axial drain port 69 at the side where the drain system of the OCV 22 is located (left side from the fifth drain port 91 in the drawing) is made larger, while an inner diameter of a part (a hydraulic fluid passage part) 69*b* of the axial drain port 69 at the side where the drain system of the OSV 29 is located (right side from the sixth drain port 92 in the drawing) is made smaller.

Even in the case of the second embodiment where the drain system of the OCV 22 and the drain system of OSV 29 share the same drain port 61, the hydraulic fluid can be discharged from the first drain port 61 through the drain system of the OCV 22 with a low flow resistance by proving the drain system of the OCV 22 on the open air side of the drain system of the OSV 29 and by increasing the hydraulic fluid passage diameter of the drain system of the OCV 22 and reducing the hydraulic fluid passage diameter of the drain system of the OSV 29. Furthermore, since the small diameter part 69*b* (the OSV 29 side) of the axial drain port 69 works as a throttle, the transmission of the hydraulic pressure fluctuation of the drain system of the OCV 22 to the drain system of the OSV 29 can be limited.

By limiting the transmission of the hydraulic pressure fluctuation, which is discharged from the OCV 22, to the drain system of the OSV 29, the operational performance of the advance drain control valve 25 and the operational performance of the retard drain control valve 28 can be improved.

Modifications

In the above embodiments, the OCV 22 and the OSV 29 share the same spool 55 as their spool valve element. Alternatively, the OCV 22 may have its own spool, and the OSV 29 may have its own spool. The spool of the OCV 22 and the spool of the OSV 29 may be placed to contact with each other in the sleeve 54. These separate spools may directly contact with each other or may indirectly contact with each other through an intermediate member.

In the above embodiments, the tubular spool 55, which has the axial drain port 69 along its axis, is used. However, the structure of the spool 55 is not limited to this. For example, the spool 55 may be formed as a solid spool, which has multiple large-diameter parts and small diameter parts for opening and closing the ports.

In the above embodiments, the tubular sleeve 54 is used. However, the sleeve 54 may be eliminated. In such a case, the spool 55 may be directly inserted into the component (e.g., the engine head), into which the complex valve (the solenoid spool valve 51 in the above embodiments) having both the OCV and the OSV is installed.

The structure of the electromagnetic actuator 53 in the above embodiments is only one example, and various other types of actuators can be used. For example, it is possible to use the electromagnetic actuator, in which the plunger 74 is arranged in the axial direction of the coil 73.

In the above embodiments, valve timing is retarded when the actuator 53 is turned off. Alternatively, the valve timing may be advanced when the actuator 53 is turned off.

In the above embodiments, the retard check valve 26 (as well as the relevant structure that includes the retard drain control valve 28) is provided in the retard fluid passage 46. However, the torque fluctuation of the camshaft 1 mostly acts toward the retard side, so that the response delay in the retard operation is less frequent in comparison to the advance operation. Thus, the retard check valve 26 (as well as the relevant structure that includes the retard drain control valve 28) may be eliminated to simplify the structure of the VVT system. Further alternatively, the advance check valve 23 (as well as the relevant structure that includes the advance drain control valve 25) may be eliminated to simplify the structure of the VVT system.

In the above embodiments, the complex valve (the solenoid spool valve 51 in the above embodiments) having the OCV and the OSV is implemented to have the spool valve structure. Alternatively, any other appropriate valve structure (e.g., a rotary valve structure) may be used in the complex valve.

In the above embodiments, the electromagnetic actuator 53 is used as the actuator, which drives the complex valve having the OCV and the OSV. Alternatively, any other appropriate actuator may be used. For example, it is possible to use an electric actuator, which converts rotation of an electric motor into an axial force and applies the converted axial force to the spool 55. Also, any other type of electric actuator, such as a piezoelectric actuator may be used. Further alternatively, the complex valve having the OCV and the OSV may be driven by the pilot hydraulic pressure.

In the above embodiments, the VCT mechanism 2 is provided to the camshaft 1. Alternatively, the VCT mechanism 2 may be provided to any other appropriate part, such as the engine crankshaft.

The VCT mechanism 2, which is shown and described in the above embodiments, is the mere example. The above embodiments may be modified as long as the valve timing can be advance-controlled using the hydraulic actuator of the VCT mechanism 2.

For example, in the above embodiments, the three shoes 8*a* are used to divide the interior of the housing rotor 4 into the three recesses, and the three vanes 5*a* are provided on the outer peripheral part of the vane rotor 5. However, the number of the shoes 8*a* and the number of the vanes 5*a* may be changed to any other number as long as at least one shoe 8*a* and at least one vane 5*a* are provided.

Furthermore, the housing rotor 4 rotates with the crankshaft, and the vane rotor 5 rotates with the camshaft 1 in the above embodiments. Alternatively, the vane rotor 5 may rotate with the crankshaft, and the housing rotor 4 may rotate with eh camshaft 1.

Additional advantages and modifications will readily occur to those skilled in the art. The invention in its broader terms is therefore not limited to the specific details, representative apparatus, and illustrative examples shown and described.

What is claimed is:

1. A valve timing control system for an internal combustion engine, comprising:

a variable valve timing mechanism that includes:

an advance chamber that exerts a drive hydraulic pressure in an advance operation to rotate an output-side rotor, which drives a camshaft of the internal combustion engine, toward an advance side relative to an input-side rotor, which is driven by a crankshaft of the internal combustion engine; and a retard chamber that exerts a drive hydraulic pressure in a retard operation to rotate the output-side rotor toward a retard side relative to the input-side rotor;

a phase control valve that supplies and drains the drive hydraulic pressure relative to the advance chamber and the retard chamber;

a hydraulic control arrangement that controls hydraulic communication between the variable valve timing mechanism and the phase control valve and includes at least one of:

a combination of an advance check valve and an advance drain control valve, wherein the advance check valve is provided in an advance hydraulic passage, which conducts a control hydraulic pressure of the phase control valve to the advance chamber, to enable hydraulic fluid to flow from the phase control valve to the advance chamber and to limit the hydraulic fluid to flow from the advance chamber to the phase control valve, and the advance drain control valve is provided in an advance check valve bypass passage, which bypasses the advance check valve, and is driven by a pilot hydraulic pressure to open and close the advance check valve bypass passage;

a combination of a retard check valve and a retard drain control valve, wherein the retard check valve is provided in a retard hydraulic passage, which conducts the control hydraulic pressure of the phase control valve to the retard chamber, to enable hydraulic fluid to flow from the phase control valve to the retard chamber and to limit the hydraulic fluid to flow from the retard chamber to the phase control valve, and the retard drain control valve is provided in a retard check valve bypass passage, which bypasses the retard check valve, and is driven by a pilot hydraulic pressure to open and close the retard check valve bypass passage; and a drain switch valve that supplies and drains the pilot hydraulic pressure relative to at least one of the advance drain control valve and the retard drain control valve, wherein the phase control valve and the drain switch valve are integrated together as a complex valve and are driven by a common actuator.

2. The valve timing control system according to claim 1, wherein the complex valve includes a spool, which is commonly used as a valve element of the phase control valve and a valve element of the drain switch valve.

3. The valve timing control system according to claim 1, wherein the phase control valve is provided on an open air side of the drain switch valve in the complex valve.

4. The valve timing control system according to claim 1, wherein the complex valve includes a drain port that forms both of:

at least part of a drain port of the phase control valve, from which the drive hydraulic pressure is drained from the phase control valve; and at least part of a drain port of the drain switch valve, from which the pilot hydraulic pressure is drained from the drain switch valve.

5. The valve timing control system according to claim 4, wherein the complex valve includes a pressure pulsation transmission limiting means for limiting transmission of hydraulic pressure fluctuation of a drain system of the phase control valve to a drain system of the drain switch valve.

6. The valve timing control system according to claim 5, wherein the pressure pulsation transmission limiting means is a drain separating means for discharging the hydraulic pressure from the drain system of the phase control valve and the hydraulic pressure from the drain system of the drain switch valve through different drain ports, respectively, in the advance operation and also for discharging the hydraulic pressure from the drain system of the phase control valve and the hydraulic pressure from the drain system of the drain switch valve through the different drain ports, respectively, in the retard operation.

7. The valve timing control system according to claim 5, wherein:

the drain system of the phase control valve and the drain system of the drain switch valve in the complex valve share a common drain port; and the pressure pulsation transmission limiting means is constructed such that the drain system of the phase control valve is provided on an open air side of the drain system of the drain switch valve, and a diameter of a hydraulic fluid passage part of the drain system of the phase control valve is set to be larger than a diameter of a hydraulic fluid passage part of the drain system of the drain switch valve.

* * * * *